United States Patent [19]

Lofgren

[11] Patent Number: 4,734,660

[45] Date of Patent: Mar. 29, 1988

[54] SIGNAL POLARIZATION ROTATOR

[75] Inventor: Frederick W. Lofgren, Charlton, Mass.

[73] Assignee: Northern Satellite Corporation, Hopkinton, Mass.

[21] Appl. No.: 866,774

[22] Filed: May 23, 1986

[51] Int. Cl.[4] ..... H01P 1/165

[52] U.S. Cl. ..... 333/21 A; 333/26; 343/186

[58] Field of Search ..... 333/21 R, 21 A, 26, 333/33, 34; 343/756, 786

[56] References Cited

U.S. PATENT DOCUMENTS

| | | | |
|---|---|---|---|
| 2,773,254 | 12/1956 | Engelmann | 333/26 X |
| 2,880,399 | 3/1959 | Murphy | 333/21 R X |
| 2,981,904 | 4/1961 | Ajioka et al. | 333/34 |
| 4,533,884 | 8/1985 | Hudspeth et al. | 333/26 |
| 4,574,258 | 3/1986 | Cloutier | 333/21 A |
| 4,672,388 | 6/1987 | Grim | 333/21 A X |
| 4,679,009 | 7/1987 | Cloutier | 333/21 A |

*Primary Examiner*—Paul Gensler

*Attorney, Agent, or Firm*—Donald Brown

[57] ABSTRACT

The signal polarization rotator of this invention utilizes a rotatable signal transition structure having one section which acts as a coaxial transmission line center conductor, a section suspended over a first ground plane, a section above a second ground plane, the latter section varying in distance from the ground plane in an exponential, exponential like or linear taper, and optionally an extended section which in the preferred embodiment is used because of waveguide dimensions and acts as approximately a one quarter wavelength gap radiator and a section coupled to the coaxial center conductor and the gap radiator.

16 Claims, 8 Drawing Figures

SIGNAL POLARIZATION ROTATOR

BACKGROUND OF THE INVENTION

This invention is directed to a device for performing a transition from the transverse electromagnetic (TEM) dominant coaxial transmission line mode to the transverse electric ($TE_{11}$) dominant circular waveguide mode or vice versa.

An application of the device of the invention is in the reception of linear polarized microwave signals e.g., from a commerical TV satellite antenna in a system which features frequency reuse through cross polarized signals. This device would allow the alternate reception of one or the opposite polarization with equal efficiency.

The device of this invention is particularly adapted to function at a frequency in the $GH_z$ frequency range e.g., 10.9 to 12.2 $GH_z$ at less than milliwatt power levels e.g. 100 db less than one milliwatt. It is easy to construct, provides low standing wave ratios and provides improved operational results in comparison to the prior art such as shown in U.S. Pat. No. 4,414,516 without substantial tuning being required.

BRIEF DESCRIPTION OF THE INVENTION

This invention is directed to a signal polarizer rotator device which is constructed of a rotatable element preferably constructed using electrically conductive sheet material e.g., aluminum, copper, phosphor bronze or using a continuous wire conductor having the shape of the outer (perimeter) edges of the sheet material. The rotatable element has an edge which is suspended over one ground plane of a circular waveguide formed by the rear wall thereof, and an edge which has an exponential or partially exponential shape or tapered shape with respect to another ground plane of the circular waveguide formed by the longitudinal wall of the circular waveguide and other edges (sections) which act in combination with the above mentioned edges (sections). The element is preferably supported by a dielectric material e.g., polystyrene, or other plactic e.g., Rexolite brand plastic or Teflon brand plastic for rotation between a circular waveguide and a rectangular waveguide. By rotating the dielectric (insulator) support e.g., by a servo motor, the signal conducting (transmission) element is rotated e.g., 90° from vertical to receive horizontal polarization or is maintained vertical to receive vertical polarization signals and thus it is possible to launch a linearly polarized wave in a particular orientation.

DETAILED DESCRIPTION

Figure 2A:
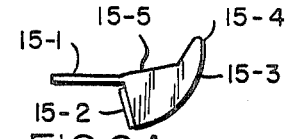
FIG. 2A is a side view of the preferred form of the transition element 15 to actual scale in inches.
Figure 2B:
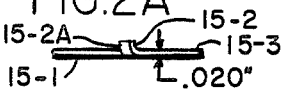
FIG. 2B is a view from the bottom of FIG. 2A.

Reference should now be had to FIGS. 1, 2, 2A, 2B and 3 for a detailed description of the preferred embodiment.

At 10 there is shown the rotator of this invention comprising a circular waveguide 11 and a rectangular waveguide 12. The circular waveguide has a back (rear) wall 11-1 which acts in this invention as a first ground plane and a longitudinal wall 11-2 which acts as a second ground plane. An opening 11-3 extends between the circular waveguide 11 and the rectangular waveguide 12. Positioned within the opening, 11-3 in a bearing 14 and an opening 12-1 in the rectangular waveguide 12 is a dielectric (insulator) rod 13 e.g., polystyrene or other plastic which is rotatable e.g., by a servo motor 16.

Figure 2:
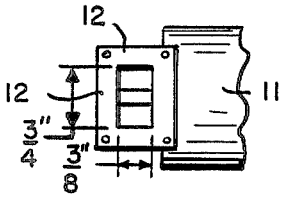
FIG. 2 is a top plan view of the rotator of this invention.
Figure 1:
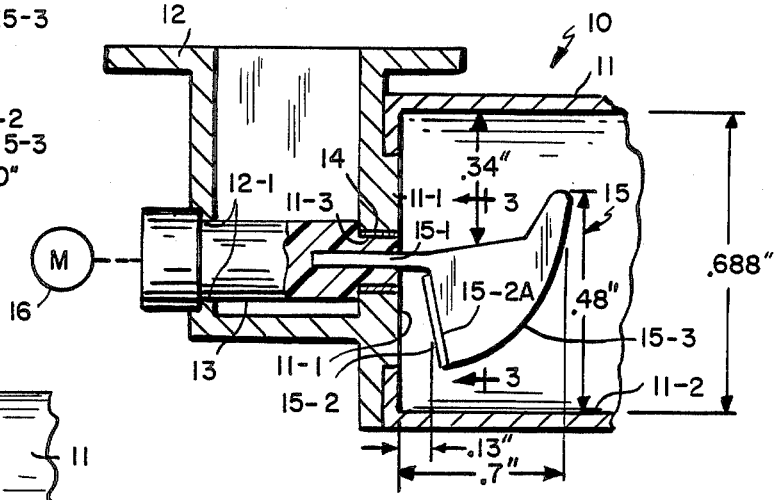
FIG. 1 is a partial sectional view of the preferred embodiment signal polarization rotator of this invention.
Figure 3:
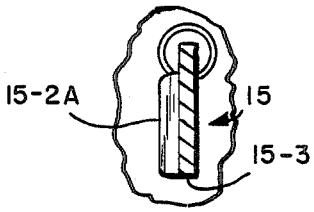
FIG. 3 is a sectional view taken along line 3—3 in FIG. 1.

At 15 in FIGS. 1 to 3 there shown a transition device (element) 15 for performing a transition from the transverse electric ($TE_{11}$) dominant circular waveguide mode caused to be generated in the circular waveguide by energy feed into it to the transverse electromagnetic (TEM) dominant coaxial transmission line mode or vice versa in the opening 11-3.

The $TE_{11}$ transverse electric signal is converted to the TEM coaxial mode in the section formed in the opening 11-3 where one has a center conductor spaced apart from metal walls. The conductor 15-1 as will be described launches the $TE_{10}$ transverse electric in the rectangular waveguide 12 which is then provided to an amplifier not shown.

The transition device 15 consists of a long, thin electrically-conducting section 15-1 forming the center conductor of the coaxial line having a portion thereof fixedly supported by the rotatable rod 13 a section 15-2 suspended above a ground plane formed by back wall 11-1 and a section 15-3 positioned above a ground plane formed by the longitudinal wall 11-2. The section 15-3 varies in height above the ground plane in an exponential, exponential-like, or linear taper. The device also includes one-quarter wavelength gap radiator 15-4 (the gap is one-quarter of the guide wavelength at the center of the operating frequency band) and a section 15-5 of extremely high impedance (the high impedance is provided by spacing distance i.e. the air gap between longitudinal wall 11-2 above it and the back wall 11-1).

The transition device may be manufactured in one or several pieces. Section 15-2 to 15-5 may be the perimeter of a single sheet of conducting material e.g., copper which can be stamped out of a larger sheet.

Section 15-1 may be a continuation of the conducting material or may be a wire attached to form a continuous conductor.

The one-quarter wavelength gap radiator 15-4 is used in FIGS. 1 to 3 because of the dimensions of the waveguide. The one-quarter wavelength gap is measured from the maximum height of 15-4 (tip) above the surface 11-2 when the device 15 is as shown in FIG. 1 at the center frequency of the band.

The thickness of the conducting material is unimportant to the function as a radiator, but is used to control the impedance of the stripline construction element sections in order to provide an acceptable impedance match e.g., 0.020" thick material is acceptable. For the preferred impedance matching a right angled section 15-2A (tab, flange) is provided to fine tune the system.

Figure 4:
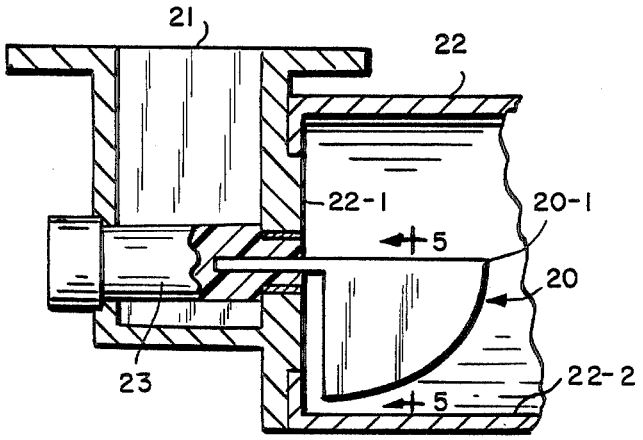
FIG. 4 is a sectional view similar to FIG. 1 showing a different form of the signal conducting transition means of this invention.
Figure 5:
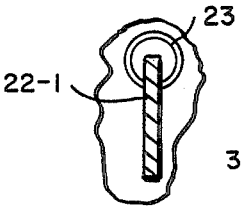
FIG. 5 is a sectional view taken along line 5—5 in FIG. 4.

Reference should now be had to FIGS. 4 and 5 which disclose a modified form of the transition device. In these figures the transition device is shown at 20 and is rotatable with the dielectric rod 23. The rectangular waveguide in the form of a square waveguide is shown at 21 with the circular waveguide 22 having the back wall 22-1 and longitudinal wall at 22-2.

In this figure the gap radiator 15-4 projection is not needed because of the modified dimensions at the frequency used for the circular waveguide and the tip 20-1 therefore acts as the gap radiator.

Figure 6:
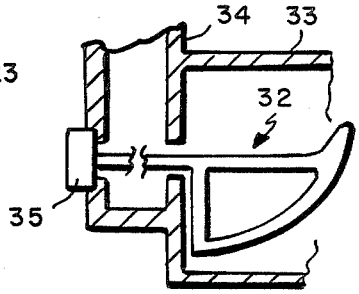
FIG. 6 is another form of the signal conducting transistion means of this invention supported in a different fashion.

FIG. 6 illustrates the transition device 32 constructed by continuous metal wire positioned in a circular waveguide 33 and a rectangular waveguide 34. This structure acts similar to the transition device 15 perimeter and in fact could be cut out from a metal sheet. In this FIG. 6 the dielectric rod is dispensed with and the air gap in the opening between waveguides acts as the dielectric. Device 32 could also be supported in dielectric material e.g., enclosed therein to provide the same function. The device 32 may be terminated by a resonator 35 and is rotatable.

In this invention, microwave energy may be received by the circular waveguide e.g., from a feed horn and is launched into the rectangular waveguide through section 15-1. The transition device 15 is rotated by servo motor 16 to vertical (as shown in drawing) or horizontal depending on the external source polarization or skewed (i.e. positioned off vertical position) depending upon satellite polarization skew of the transmitted signal. It should also be realized that the transition device need not be retained by a solid dielectric rod if the air gap in the opening 11-3 were used as the dielectric and section 15-1 were supported by a device supported in or by the rectangular waveguide.

I claim:

1. A microwave device comprising:

(1) a rectangular waveguide;

(2) a circular waveguide having rear wall and a longitudinal wall;

(3) said rear wall defining an opening through which the circular waveguide is coupled to said rectangular waveguide;

(4) a rotatable dielectric member positioned in said opening and in said rectangular waveguide, and (5) electrically conductive transition means supported by said dielectric member for rotation therewith, said transistion means comprising a first section, a portion of which is supported in said dielectric, said portion of said first section extending into said rectangular waveguide and into said circular waveguide, a second section coupled to said first section which is suspended away from said rear wall of said circular waveguide and is coupled to a third section which varies in distance from said longitudinal wall of said circular waveguide, with the distance from the longitudinal wall progressingly getting greater as the distance of the section from the rear wall of the circular waveguide increases, a gap radiator tip section coupled to said third section and a fourth section which is coupled between said gap radiator and said first section.

2. The device according to claim 1 in which said transistion means comprises the perimeter of a sheet of electrically conductive material.

3. The device according to claim 1 in which said transistion means comprises a wire shaped to form said sections.

4. The device of claim 1 in which second section includes a tab portion.

5. The device of claim 1 including means for rotating said device.

6. The device of claim 1 in which said third section varies in height in an exponential taper.

7. The device of claim 1 in which said third section varies in height in an exponential-like taper.

8. The device of claim 1 in which said third section varies in height substantially in a linear taper

9. A microwave device comprising a circular waveguide for launching the $TE_{11}$ transverse electric signal in a circular waveguide based on received microwave energy, and an electrically conductive metal element partially positioned in said circular waveguide for converting the $TE_{11}$ transverse electric signal to the TEM coaxial mode in a opening at the rear of the waveguide into which a portion of the element extends, said element comprising a first section which acts as the center of a coaxial line and extends into said opening, a second section which is suspended over the rear terminating wall of the circular waveguide, a curved or tapered section which progressively gets further away from the longitudinal inner wall of the circular waveguide as it extends away from said second section, a gap radiator section, and a high impedance section coupled between said gap radiator section and said first section.

10. The device of claim 9 in which a rectangular waveguide opens into said opening at the rear of said circular waveguide and said first section of the element extends into said rectangular waveguide to launch a $TE_{10}$ transverse electric signal in said rectangular waveguide.

11. The device of claim 10 in which said second section includes a flange impedance matching portion.

12. A microwave device comprising:

(1) a rectangular waveguide;

(2) a circular waveguide having rear wall and a longitudinal wall;

(3) said rear wall defining an opening through which the circular waveguide is coupled to said rectangular waveguide;

(4) a rotatable dielectric member positioned in said opening and in said rectangular waveguide; and (5) electrically conductive transition means supported by said dielectric member for rotation therewith, said transition means comprising a first electrically conductive section, a portion of which is supported in said dielectric, said portion of said first section extending into said rectangular waveguide and into said circular waveguide, a second electrically conductive section coupled to said first section which is suspended away from said rear wall of said circular waveguide and is coupled to a third electrically conductive section which varies in distance from said longitudinal wall of said circular waveguide, with the distance from the longitudinal wall progressingly getting greater as the distance of the section from the rear wall of the circular waveguide increases, a projecting tip electrically conductive section coupled to said third section and a fourth electrically conductive section which is coupled between said projecting tip section and said first section.

13. The device according to claim 12 in which said transition means comprises a sheet of electrically conductive material.

14. The device according to claim 12 in which said transition means comprises a wire shaped to form said sections.

15. The device of claim 12 including means for rotating said rotatable member.

16. A microwave device comprising:

(1) a rectangular waveguide;

(2) a circular waveguide having rear wall and a longitudinal wall;

(3) said rear wall defining an opening through which (3) the circular waveguide is coupled to said rectangular waveguide;

(4) a rotatable dielectric member positioned in said opening and in said rectangular waveguide; and (5) electrically conductive transition means supported by said dielectric member for rotation therewith; said transition means comprising a first section, a portion of which is supported in said dielectric, said portion of said first section extending into said rectangular waveguide and into said circular waveguide, a second section coupled to said first section which is suspended away from said rear wall of said circular waveguide and is coupled to a third section which varies in distance from said longitudinal wall of said circular waveguide, with the distance from the longitudinal wall progressing getting greater as the distance of the section from the rear wall of the circular waveguide increases, a projecting tip section coupled to said third section and a fourth section which is coupled between said projecting tip section and said first section, and a tab section extending from said second section.

* * * * *